United States Patent [19]

Leader, Jr.

[11] Patent Number: 5,065,677

[45] Date of Patent: Nov. 19, 1991

[54] PRINTING PLATE MOUNTING AND PROOFING APPARATUS

[75] Inventor: Charles B. Leader, Jr., Napoleon, Ohio

[73] Assignee: Leader Engineering Fabrication Inc., Napoleon, Ohio

[21] Appl. No.: 457,558

[22] Filed: Dec. 27, 1989

[51] Int. Cl.[5] ..... B41F 27/06

[52] U.S. Cl. ..... 101/415.1; 101/DIG. 36; 101/389.1

[58] Field of Search ..... 101/DIG. 36, 415.1, 101/131, 131.5, 132, 132.5, 133, 378, 407.1, 418, 216, 382.1, 383, 389.1; 33/614, 617, 621

[56] References Cited

U.S. PATENT DOCUMENTS

| | | | |
|---|---|---|---|
| 3,192,844 | 7/1965 | Szasz et al. | 33/617 |
| 3,407,727 | 10/1968 | Fischer | 101/248 |
| 3,477,370 | 11/1969 | Fischer | 101/248 |
| 3,496,865 | 2/1970 | Fischer | 101/248 |
| 3,550,283 | 12/1970 | Bernardi et al. | 33/618 |
| 3,566,763 | 3/1971 | Knopf | 101/DIG. 36 |
| 3,616,055 | 10/1971 | Mages | 101/DIG. 36 |
| 3,679,316 | 7/1972 | Boujon | 356/168 |
| 3,941,486 | 3/1976 | Tyler | 356/172 |
| 4,004,509 | 1/1977 | Moss | 101/DIG. 36 |
| 4,018,528 | 4/1977 | Dennis | 101/DIG. 36 |
| 4,033,259 | 7/1977 | Schuhmann | 101/174 |
| 4,449,452 | 5/1984 | Mansell | 101/DIG. 36 |
| 4,599,122 | 7/1986 | Nakamura | 101/DIG. 36 |
| 4,613,395 | 9/1986 | Hasegawa | 101/DIG. 36 |
| 4,705,590 | 11/1987 | Vankenberg | 101/415.1 |
| 4,743,324 | 5/1988 | Boyce et al. | 33/621 |
| 4,827,626 | 5/1989 | Wieland | 33/614 |
| 4,872,407 | 10/1989 | Banke | 101/DIG. 36 |

*Primary Examiner*—Edgar S. Burr
*Assistant Examiner*—Joseph R. Keating
*Attorney, Agent, or Firm*—Marshall & Melhorn

[57] ABSTRACT

An apparatus for mounting flexible printing plates on a printing cylinder includes a base rotatably supporting a printing cylinder in a predetermined position and an adjacent support table having a turntable for supporting a flexible printing plate having a reference point thereon. Actuators move the support table along three orthogonal axes one of which is parallel to the longitudinal axis of the printing cylinder. The position of the reference point is sensed by a video camera and feedback signals representing the positions of the camera and the table with respect to the three axes are inputs to a computer. The computer determines the positional relationship between the reference point on the printing plate and the predetermined position of the printing cylinder and moves the support table and the turntable to position the printing plate at a desired position for mounting on the printing cylinder. A plurality of grooves formed in the turntable are selectively connected to a vacuum source to retain the printing plate. The printing cylinder is rotated by a drive motor through an anti-backlash gearbox.

31 Claims, 8 Drawing Sheets

PRINTING PLATE MOUNTING AND PROOFING APPARATUS

BACKGROUND OF THE INVENTION

The present invention relates generally to an apparatus for mounting printing plates and, in particular to an apparatus for mounting flexible printing plates on press cylinders.

In one form of the printing process, printing is effected by photopolymer or rubber printing plates mounted on cylinders, the paper to be printed being impressed on the inked printing plate. The cylinder on which the printing plates are mounted is generally called the plate or printing cylinder. The quality of a printing job depends, in a large measure, on the care in which pre-press preparations are carried out. Plate-mounting, color registration and proofing are effected off the press by means of commercially available mounting-proofing machines designed for this purpose.

The mounting of photopolymer or other printing plates onto plate cylinders for printing therefrom requires a high degree of accuracy in the alignment thereof. The image must be square and in register on the cylinder in order to print square and in register on the work. In the printing of colors or in the superimpression of images, the various colors or images are added sequentially. Accordingly, it is important that in each case the printing plate which is adding the successive color or image be synchronized with the preceding plate or plates so that the colors or images are accurately superimposed. To arrange these plates in the exact predetermined relation to one another requires that their angular as well as their transverse position on the printing plate support means be accurately determined. In the prior art this synchronizing has been performed by mechanical methods and apparatus which are complicated in their implementation and easily subject to inaccuracies. In addition, in the past the synchronizing of the printing plates has been done while they were in position in the printing press. This is not only inconvenient and presents difficult working conditions, but also the printing press is out of operation during this time.

One common method to effect the alignment of the plates with respect to the print cylinder involves the drawing of a line around the print cylinder. This line is then aligned by eye with a longitudinal line along the length of the photopolymer or other print plate. This method is relatively accurate but can be extremely time consuming for the operator. This leads to delay between print runs and is costly with respect to the time lost between such runs.

Alternatively, there is commercially available a device to aid in the alignment of photopolymer or printing plates onto the print cylinder. The print cylinder is placed in a fixed relationship to the device and the plate is laid upside down on a clear glass top. By means of a series of mirrors having lines drawn thereon, the plate is aligned relative to the print cylinder. However, this device is also relatively time consuming and the required accuracy is not achieved. There is only a one-to-one relationship between the eye of the operator and the device assisting in the alignment which can lead to errors of up to one millimeter. These errors are unacceptable where accurate printing is required. This device is generally only acceptable for the alignment of printing plates with respect to one another rather than with respect to the print cylinder.

These machines, which usually make use of an optical mounting system, make it possible to mount the plates on plate cylinders to effect exact color registration, a procedure essential to the maintenance of both quality and economy in all flexible plate printing operations. Pre-proofing is, in many respects, the most important of all pre-press preparations, for it not only indicates the appearance of the final reproduction, but it also affords means to check the mounting of the plates for color sequence, spacing requirements, layout and gear size, as well as copy and color separation.

Mounting-proofing machines have been provided with a proofing cylinder (sometimes called the impression cylinder) which cooperates with the printing cylinder, the proofing cylinder making contact with the printing plates on the printing cylinder and rotating concurrently therewith to print a proof on a sheet secured to the proofing cylinder. In commercial machines of the type heretofore known which make use of optical mounting techniques, the proofing or impression cylinder is supported for rotation in a fixed position, whereas the printing cylinder is moveable, usually in a vertical direction, from a mounting state in which it is retracted relative to the proofing cylinder to a proofing state in which it is in engagement therewith.

The proofing and printing cylinders are mechanically intercoupled, whereby rotation of the proofing cylinder causes the printing cylinder to rotate. When the diameter of the proofing cylinder is the same as the printing diameter of the printing cylinder (i.e., the diameter of the printing cylinder plus the thickness of the printing plates thereon). then a one-to-one relationship exists therebetween. However, printing cylinders are manufactured in a range of diameters for printing different print lengths. Therefore, it has been necessary to adjust the phase relationship between the printing and proofing cylinders to accommodate the differences between the cylinder diameters. For adjusting this phase relationship for different printing cylinder diameters, a relatively complex mechanism is required in existing types of mounting-proofing machines.

Another drawback of existing types of mounting-proofing machines is their limited capacity to handle printing cylinders of different diameter. With machines of the type heretofore known, the capacity of the machine is restricted to a range of printing cylinder diameters extending from about ninety-five percent of the diameter of the proofing cylinder down to about twenty-five or thirty percent thereof, or approximately four to one. Moreover, since in existing structures, the proof forces imposed at contact are eccentrically opposed, the structures required to accommodate these magnified forces are too large to permit smaller sizes of printing cylinders to fit the machine.

SUMMARY OF THE INVENTION

The present invention concerns an apparatus for mounting and proofing flexible printing plates to an accuracy of plus or minus 0.002 inches along the width and circumference of a printing cylinder. The apparatus mounts the plates on a printing cylinder which is rotatably supported in a predetermined position. An adjacent support table has a surface for supporting a flexible printing plate having a reference point thereon. Actuators move the support table along three orthogonal axes one of which is parallel to the longitudinal axis of the printing cylinder. The position of the reference point is sensed by a video camera and feedback signals representing the positions of the camera and the table with respect to the three axes are inputs to a computer.

The computer determines the positional relationship between the reference point on the printing plate and the predetermined position of the printing cylinder and moves the support table to position the printing plate at a desired position for mounting on the printing cylinder. Each of the actuators includes a drive motor and a motor driver connected between the associated drive motor and the computer. A feedback generator is connected between the drive motor and its associated motor driver for generating the feedback signals to the computer.

The support table has a turntable formed therein for supporting the printing plates and an actuator rotates the turntable about a central axis to position the plate with respect to the printing cylinder. The turntable has a plurality of grooves formed in an upper surface thereof, and a vacuum pump connected to the grooves through a plurality of associated valves and manifold blocks for selectively controlling the application of a vacuum to each of the grooves. The vacuum is applied to the grooves corresponding to the size of the printing plate to retain the plate on the upper surface of the turntable. Each manifold block has an inlet connected to one end of a vacuum supply line and in fluid communication with an elongated outlet passage formed in the block and positioned below the associated groove. The turntable has a plurality of apertures formed between a bottom wall of each groove and a lower surface of the turntable for fluid communication between the outlet passage and the associated groove.

The present invention includes means for rotating the printing cylinder including a gearbox having a drive motor coupled to an input and drive shaft coupling coupled to an output. The gearbox has a worm gear drive connected between the input and the output and means for adjusting backlash in the worm gear drive. The worm gear drive includes a worm connected to the input and a split gear connected to the output. The split gear has a right hand portion and a left hand portion and the means for adjusting backlash rotates the split gear portions relative to one another.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
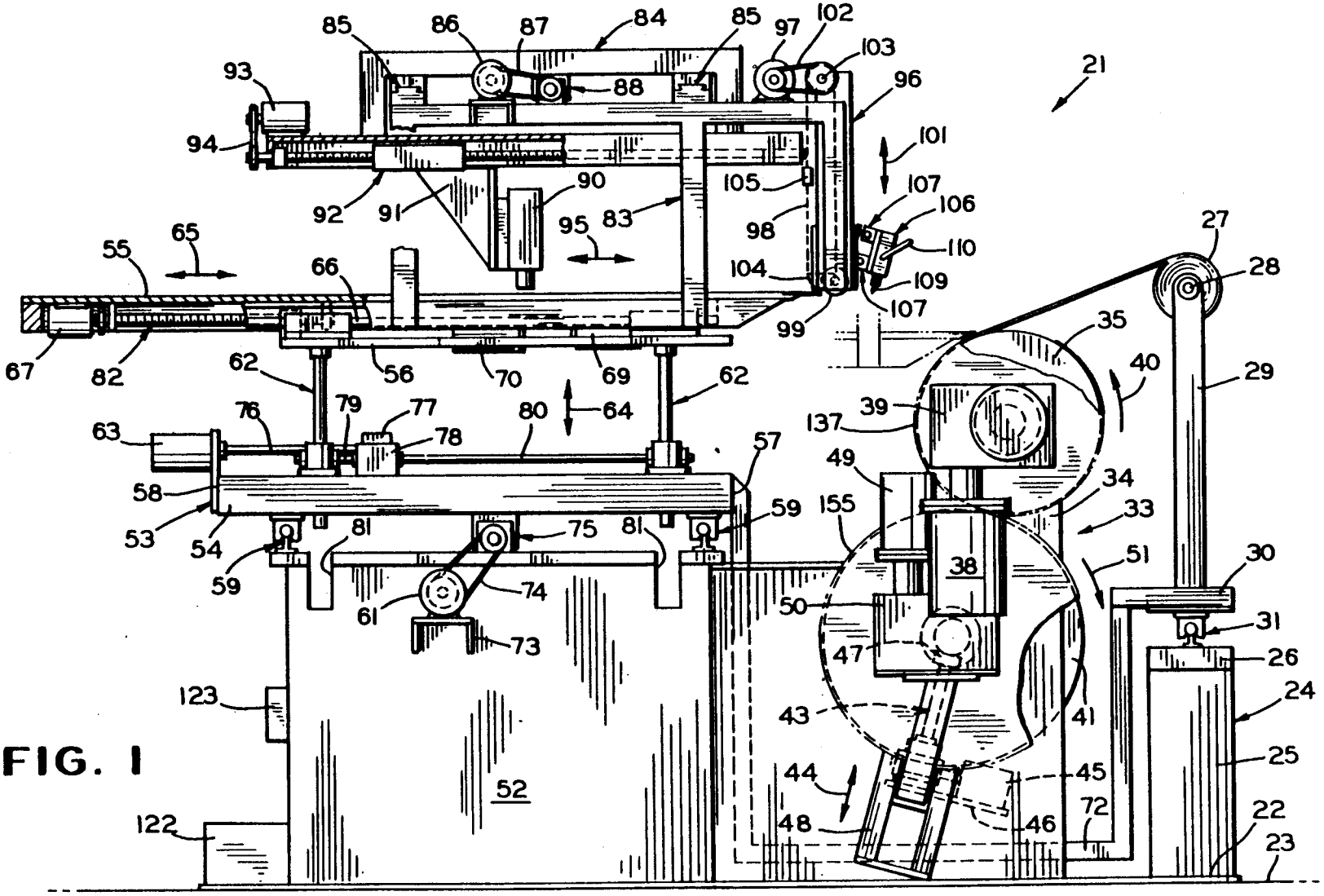
FIG. 1 is a left side elevational view of a mounting and proofing apparatus in accordance with the present invention.
Figure 2:
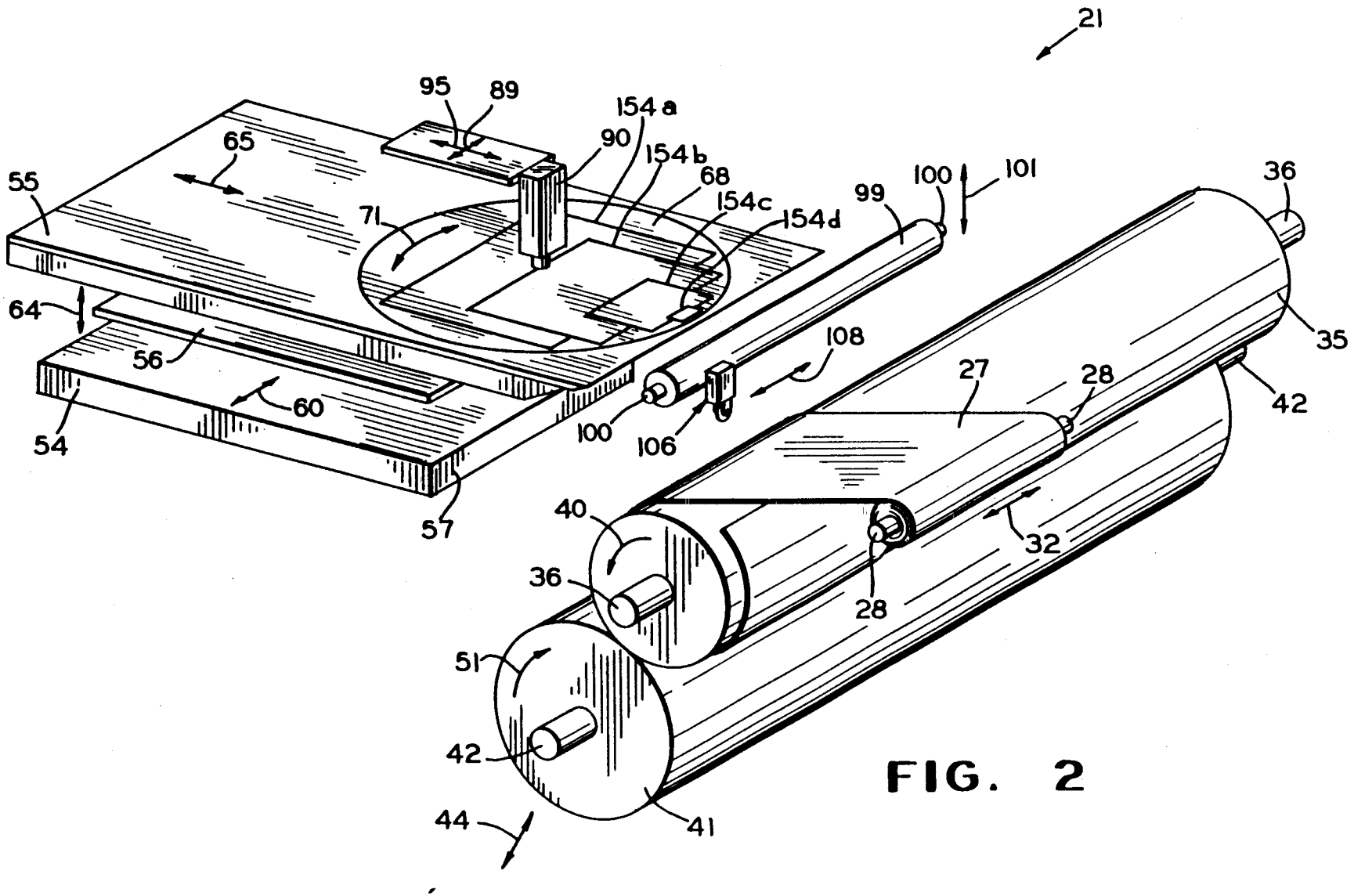
FIG. 2 is schematic perspective view of the apparatus shown in FIG. 1.

Referring to FIGS. 1 and 2, there is shown a mounting and proofing apparatus 21 for aligning and mounting flexible printing plates on printing cylinders for use on flexographic or rotary presses. As shown in FIG. 1, the apparatus 21 includes a generally horizontally extending base 22 adapted to be mounted on a solid surface such as a building floor 23. A first support 24 is positioned at the front of the apparatus 21 and includes a pair of generally vertically extending legs 24 (only one is shown) positioned at opposite sides of the apparatus 21. A track plate 26 is supported on the upper ends of the legs 24 and extends across the front of the apparatus 21 supporting a roll of mounting paper 27 which has adhesive on both sides thereof.

Referring to FIGS. 1 and 2, the mounting paper 27 is wound about a mounting paper roller 28 which roller is rotatably supported at its ends on the upper ends of a pair of spaced apart, generally vertically extending support posts 29 only one of which is shown in FIG. 1. The lower ends of the posts 29 are attached to the upper surface of a generally horizontally extending support plate 30. The support plate 30 is slidably mounted on a track or rail 31 such as a Thompson bearing which in turn is attached to an upper surface of the track plate 26. The rail 31 limits movement of the rolled paper 27 to an "X" axis of the apparatus 21 which axis extends generally perpendicular to the plane of FIG. 1. Thus, the roll of mounting paper 27, together with the roller 28, the support posts 29 and the support plate 30 are free to move back and forth along the "X" axis at the front of the apparatus 21 as shown by an arrow 32 in FIG. 2.

Figure 3:
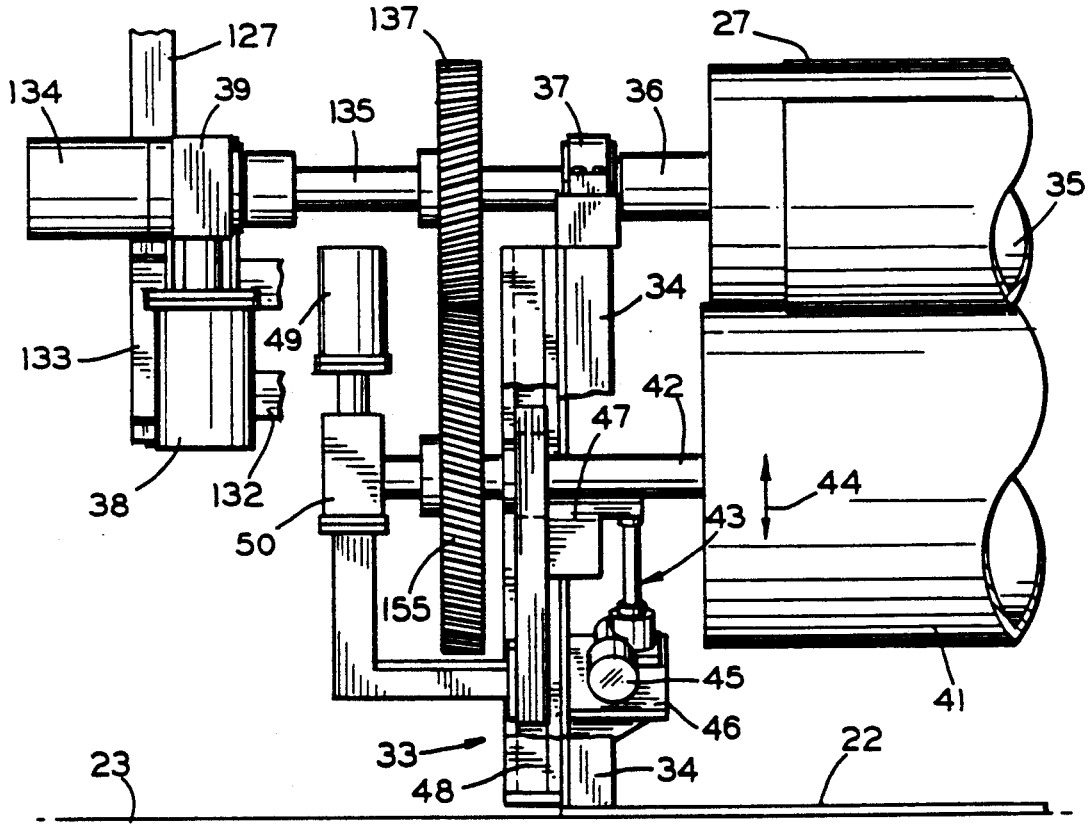
FIG. 3 is a front side fragmentary elevational view of the cylinder supporting portion of the apparatus shown in FIG. 1.

As shown in FIGS. 1 through 3, a second support 33 is mounted on the base 22 and is positioned behind (to the left in FIG. 1) of the first support 24. The second support 33 includes a pair of generally vertically extending spaced apart support posts 34 (only one of which is shown in FIGS. 1 and 3) positioned at opposite sides of the base 22. A printing cylinder 35, upon which plates are to be mounted, is rotatably supported by an axle 36 the ends of which are retained in a pair of bearing blocks 37 (one is shown in FIG. 3) attached to upper ends of the support posts 34. A printing cylinder drive motor 38 is coupled to the axle 36 through an anti-backlash gearbox 39, as explained below, for rotating the printing cylinder 35 in the direction shown by an arrow 40 in FIG. 2. The longitudinal axis of the printing cylinder 35 extends generally parallel to the "X" axis of the apparatus 21 and, thus, the printing cylinder is rotatably supported in a predetermined position on the base 22.

A proofing cylinder 41 is rotatably mounted by an axle 42 below and slightly behind (to the left in FIG. 1) the printing cylinder 35. The axle 42 is supported by a lifting means including a pair of jacks 43 attached to the inner sides of each of the support posts 34 for movement toward and away from the press cylinder 35 as shown by an arrow 44. Each of the jacks 43 has a drive motor 45 for actuating the jack and is mounted at a lower end on a support plate 46 attached to the inner side wall of the support post 34. An upper end of the jack 43 is attached to a support block 47 which retains the axle 42. The axle 42 and the support 47 extend through a slot formed in the support post 34 and are slidably movable in the direction of the arrow 44 in a slotted guide 48 attached to an outer surface of the post 34. A proofing cylinder drive motor 49 is coupled to the axle 42 through a gearbox 50 for rotating the proofing cylinder 41 in the direction of an arrow 51.

As shown in FIGS. 1 and 2, mounted on the base 22 and positioned behind (to the left in FIG. 1) the second support 33 is a third support 52. Mounted on an upper surface of the third support 52 is a generally rectangular support table 53 including a lower plate 54, an upper plate 55 and an intermediate plate 56 positioned between the plates 54 and 55. If an edge of the lower plate 54 closer to the printing cylinder 35 is designated as a front edge 57, the lower plate is supported adjacent its front edge 57 and a rear edge 58 for sliding movement along a pair of spaced apart tracks 59 attached to the upper surface of the third support 52. The tracks 59 are similar to the track 31 whereby movement of the lower plate 54 relative to the support 52 is limited to the "X" axis direction as shown by an arrow 41 in FIG. 2. Such movement can be accomplished by any suitable actuator coupled between the third support 52 and the lower plate 54 such as an "X" axis table motor 61 driving a ball screw as described below.

The intermediate plate 56 is supported above an upper surface of the lower plate 54 by four screw jacks 62 having upper ends attached at each of the corners of the intermediate plate and lower ends attached to the lower plate. The screw jacks 62 are coupled to a "Z" axis table motor 63 mounted on the rear edge 58 of the lower plate 54. The motor 63 raises and lowers the intermediate plate 56 in the direction of an arrow 64 designating a generally vertical "Z" axis of the apparatus 21.

The upper plate 55 provides movement in a "Y" axis direction, a generally horizontal direction in the plane of FIG. 1 as shown by an arrow 65. The upper plate 55 is mounted for sliding movement on a pair of tracks 66, similar to the tracks 31 and 59, attached to an upper surface of the intermediate plate 56. A "Y" axis table motor 67 is attached to and below the upper plate 55 and is coupled to a ball screw drive as described below for moving the upper plate 55 in the direction of the arrow 65. Thus, the support table 53 can be moved relative to the third support 52 and to the printing cylinder 21 along the "X" axis by the lower plate 54, along the "Y" axis by the upper plate 55 and along the "Z" axis by the intermediate plate 56.

Figure 4:
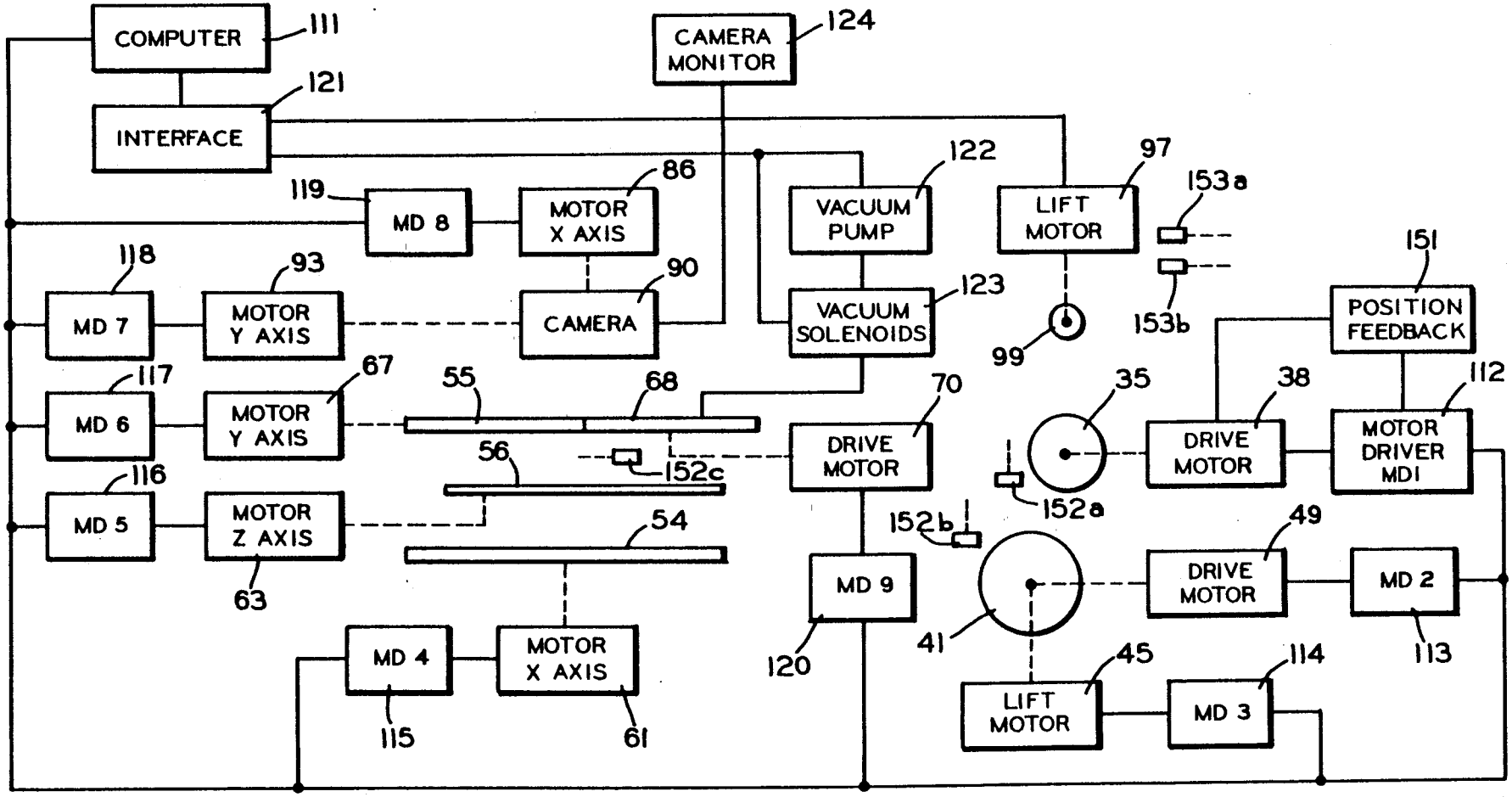
FIG. 4 is a schematic block diagram of the control system for the apparatus shown in FIG. 1.

As shown in FIGS. 2 and 4, a generally circular turntable or rotating plate 68 is mounted in an aperture formed in a front portion of the upper plate 55. The turntable 68 is attached to an output shaft of an anti backlash gearbox 69 having an input shaft coupled to a turntable drive motor 70. The gearbox 69 and the drive motor 70 are mounted on an underneath surface of the upper plate 55 for rotating the turntable 68 about its central axis in a direction of an arrow as shown in FIG. 2. The turntable includes means for retaining a printing plate as will be described in more detail below.

As shown in FIG. 1, the support plate 30 is attached to an upper end of one leg of a generally U-shaped bracket 72. The bracket 72 extends between the support posts 34 and under the proofing cylinder 41 and an upper end of its other leg is attached to the front edge 57 of the lower plate 54. Thus, the mounting paper roll 27 is moved in unison with the support table 53 generally parallel to the longitudinal axis of the printing cylinder 35. Such movement is controlled by the motor 61 which is mounted on a bracket 73 attached to the third support 52. Any suitable means such as a belt or chain 74 can be utilized to couple an output shaft of the motor 61 to a threaded shaft of a ball screw drive 75. The threaded shaft can be rotatably supported on the upper surface of the support 52 and extend parallel to the rails 59 and threadably engages a block attached to the under surface of the lower plate 54. Thus, as the motor 61 rotates the shaft, the block and the lower plate 54 will be driven along the rails 59 in a direction determined by the direction of rotation of the motor 61. At the same time, the mounting paper roll 27 will be driven along the rail 31 to maintain its position with respect to the support table 53.

The drive motor 63 for the "Z" axis is coupled by a drive shaft 76 to a gearbox 77 having a pair of outputs and being mounted on an upper surface of the lower plate 54. The outputs (not shown) of the gearbox 77 are coupled by drive shafts (not shown) to a pair of gearboxes 78 (only one is shown) mounted on the upper surface of the lower plate 54 Each of the gearboxes 78 has a pair of outputs which are coupled to drive shafts 79 and 80 each of which is connected to an associated one of the screw jacks 62. Thus, the drive motor 63 drives the four screw jacks 62 in unison to either raise or lower the plates 55 and 56 depending upon the direction of rotation of the drive motor 63. The upper surface of the third support 52 has notches 81 formed therein to accept the lower ends of the threaded shafts of the screw jacks 62 when the plates 55 and 56 are lowered.

The "Y" axis table motor 67 operates in a manner similar to the "X" axis table motor 61. The motor 67 is coupled by any suitable means to a threaded shaft of a ball screw 82 mounted on the under surface of the upper plate 55. The threaded shaft is threadably engaged by a block which is attached to an upper surface of the intermediate plate 56. Thus, the drive motor 67 rotates the shaft of the ball screw which drives the upper plate 55 on the tracks 66 in a direction along the "Y" axis determined by the direction of rotation of the drive motor 67.

As shown in FIG. 1, attached to and extending upwardly from the upper plate 55 is a frame 83 for supporting a camera and a pressure roll. Mounted on the frame 83 is a camera carriage 84 which is supported on a pair of dovetail slides 85 mounted on an upper surface of the frame 83. Thus, the camera carriage 84 is moveable with respect to the frame 83 along the same "X" axis direction of movement as the support table 53. An "X" axis drive motor 86 is mounted on the frame 83 and can be coupled by a belt or chain 87 to drive a threaded shaft of a ball screw 88. The threaded shaft is rotatably mounted on the frame 83 and threadably engages a block attached to the carriage 84. The motor 86 drives the camera carriage 84 along the "X" axis as shown by an arrow 89 in FIG. 2 in a direction depending upon the direction of rotation of the motor 86.

A camera 90 is mounted on the carriage 84 and is directed downwardly toward an upper surface of the turntable 68. The camera 90 is attached to a bracket 91 which in turn is attached to an internally threaded block of a ball screw 92. The block threadably engages a threaded shaft of the ball screw 92 rotatably mounted on the under side of the camera carriage 84. Also mounted on the camera carriage 84 is a drive motor 93. The drive motor 93 is coupled to the threaded shaft of the ball screw 92 by a belt or chain 94 Thus, the drive motor 93 moves the camera 90 along the "Y" axis in the direction of an arrow 95 depending upon the direction of rotation of the drive motor 93.

Attached to a forward end of the frame 83 is a pressure roll and cutter support 96. A pressure roll lift motor 97 is mounted on the frame 83 and is coupled to drive a pair of spaced apart, generally vertically extending endless chains 98 (only one is shown). A pressure roll 99 is rotatably mounted by an axle 100 at opposite ends thereof to the chains 98. The pressure roll 99 can be raised and lowered in the direction of an arrow 101 depending upon the direction of rotation of the lift motor 97. For example, the motor 97 can be coupled by a belt or chain 102 to a drive axle 103 having a pair of sprockets (not shown) for engaging the upper ends of the chains 98. The lower ends of the chains 98 each can be guided by a non-metallic block 104 attached to the frame 83 and an overtravel spring 105 can be provided to connect opposite ends of each of the chains.

Also mounted on the pressure roll and cutter support 96 is a cutter device 106. The cutter device 106 is slidably mounted on a pair of rails 107 similar to the track 31. The rails 107 are connected to the chains 98 for movement in the direction of the arrow 101. However, the cutter device 106 is free to move along the rails 107 in the direction of the "X" axis as shown by an arrow 108 in FIG. 2. When the upper plate 55 is in the position shown in phantom adjacent the printing cylinder 35, the pressure roll 99 and the cutter device 106 can be lowered such that a cutter blade 109 engages the mounting paper 27. A handle 110 is provided on the cutter device 106 for manually moving the cutter blade 109 across the width of the mounting paper 27 to sever a section of the paper 27 which is being wrapped around the printing cylinder 35. The cutter device 106 can be rotated through an angle of approximately forty degrees in the plane of the "Y" and "Z" axes in order to align the cutter blade 109 along a radius of the printing cylinder 35. The cutter blade 109 can also be rotated ninety degrees to enable cutting along the longitudinal axis of the mounting paper 27 as the printing cylinder 35 rotates.

In FIG. 4, there is shown a schematic block diagram of the control system for the mounting and proofing apparatus 21. The control system includes a programmed general purpose computer 111 connected to control all of the actuators and other devices described above. Each of the previously described motors, except the lift motor 97, is connected to a separate motor driver to form an actuator. The computer 111 is connected to a motor driver (MD1) 112 which in turn is connected to the drive motor 38 for the printing cylinder 35. Thus, the computer 111 generates control signals to the motor driver 112 for controlling the rotation of the printing cylinder 35. Similarly, the computer 111 is connected to a motor driver (MD2) 113 which in turn is connected to the drive motor 49 for the proofing cylinder 41. The computer 111 generates control signals to the motor driver 113 to control the rotation of the proofing cylinder 41. The computer 111 is also connected to a motor driver (MD3) 114 which in turn is connected to the lift motor 45 for the proofing cylinder 41. The motor driver 114 and the lift motor 45 are representative of two such actuators, one for each end of the proofing cylinder 41.

The computer 111 also controls the movements of the support table 53. The computer 111 is connected to a motor driver (MD4) 115 which in turn is connected to the motor 61 which is coupled to the lower plate 54 for movement along the "X" axis. The computer 111 is connected to a motor driver (MD5) 116 which is turn is connected to the motor 63 which is coupled to the intermediate plate 56 for movement of the support table along the "Z" axis. The computer 111 is connected to a motor driver (MD6) 117 which in turn is connected to the motor 67 which is coupled to the upper plate 55 for movement of the support table along the "Y" axis. Thus, the computer 111 control the three actuators for moving the support table along the three orthogonal axes.

The camera 90 is also positioned by the computer 111. The computer is connected to a motor driver (MD7) which is connected to the motor 93 which is coupled to the camera 90 for movement along the "Y" axis. The computer 111 is also connected to a motor driver (MD8) 119 which is connected to the motor 86 which is coupled to the camera 90 for movement along the "X" axis. The computer 111 is connected to a motor driver (MD9) 120 which is connected to the drive motor 70 for rotary movement of the turntable 68. By utilizing the registration marks on the printing plate, the computer controls the position of the turntable 68 to align the printing plate with the "X" and "Y" axes of the apparatus 21.

The computer 111 also controls the movement of the pressure roll 99. The computer 111 is connected through an interface 121 for generating control signals to determine the direction and duration of rotation of the lift motor 97. The computer 111 is also connected through the interface 121 to a vacuum pump 122 and a plurality of vacuum solenoids 123. The pump 122 and the solenoids 123 are mounted on the support 52 as shown in FIG. 1. The computer 111 turns on and off the vacuum pump 122 which supplies vacuum to the turntable 68 for holding the printing plates as will be described below. The plurality of vacuum solenoids 123 are connected the vacuum pump 122 and the turntable 68 and are turned on and off by the computer 111 in accordance with the size and position of the printing plate on the turntable 68.

The camera 90 is conventional video camera which generates a visual display to a camera monitor 124. The camera 90 reproduces on the camera monitor 124 a representation of the upper surface of the printing plate area over which the camera is suspended. The camera 90 can be driven by the motors 86 and 93 across the surface of the printing plate until a registration mark is located. Information is generated back to the computer 111 as to the position of the camera 90, and thus the position of the registration mark, with respect to the upper surfaces of the upper plate 55 and the turntable 68. Through feedback, the computer 111 also knows the position of the support table with respect to the three orthogonal axes.

Figure 5:
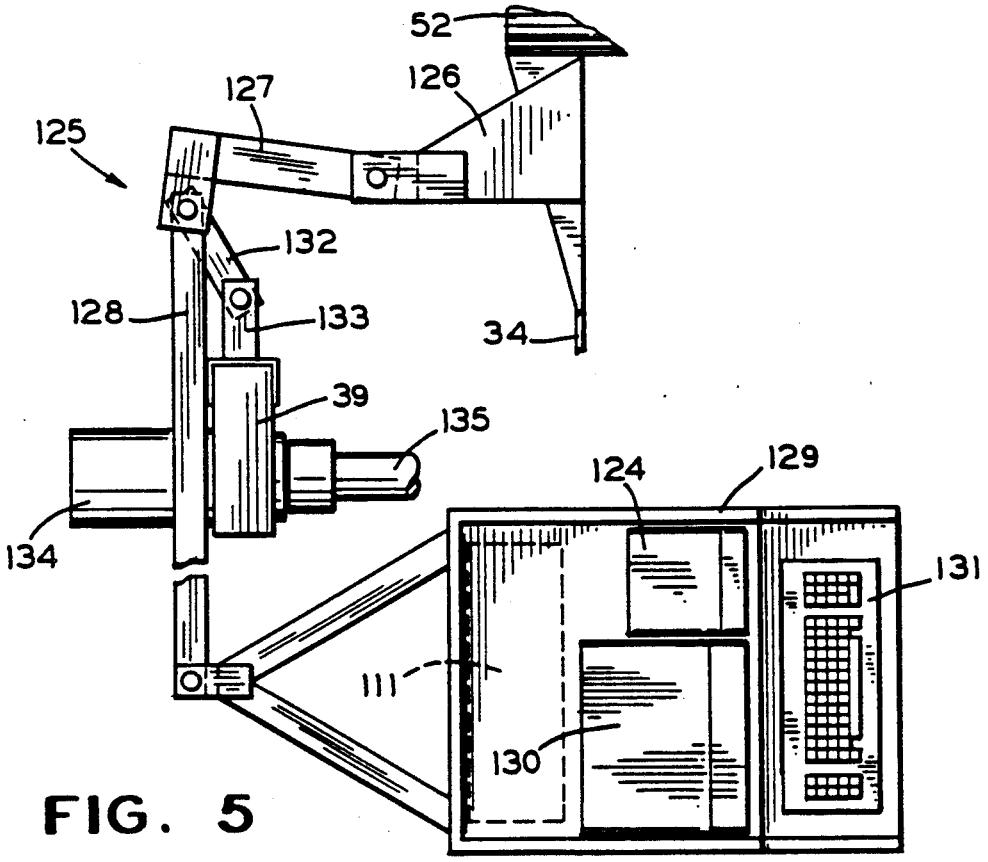
FIG. 5 is a fragmentary top plan view of a support frame for a printing cylinder drive, a computer and a camera monitor for use with the apparatus shown in FIG. 1.
Figure 7:
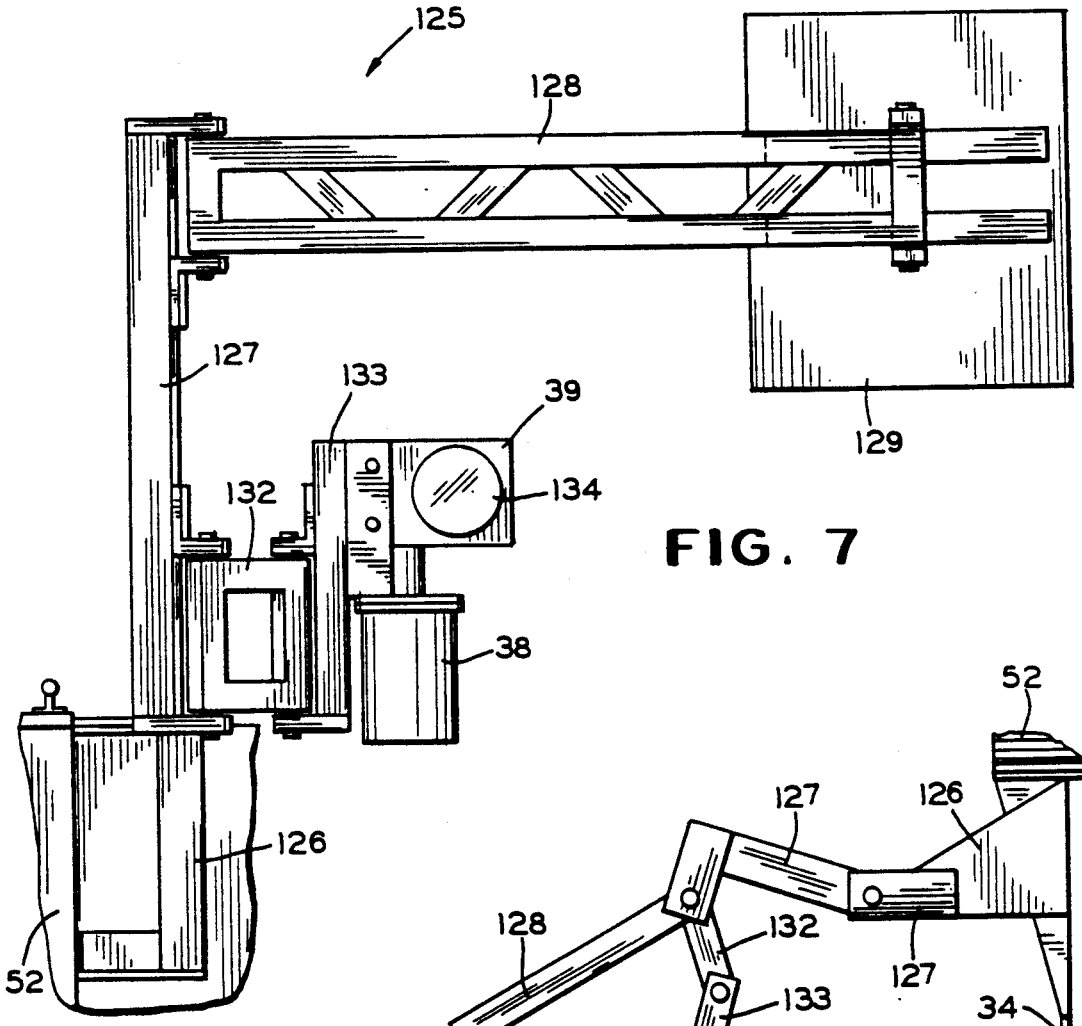
FIG. 7 is a fragmentary side elevational view of the support frame shown in FIG. 5.
Figure 6:
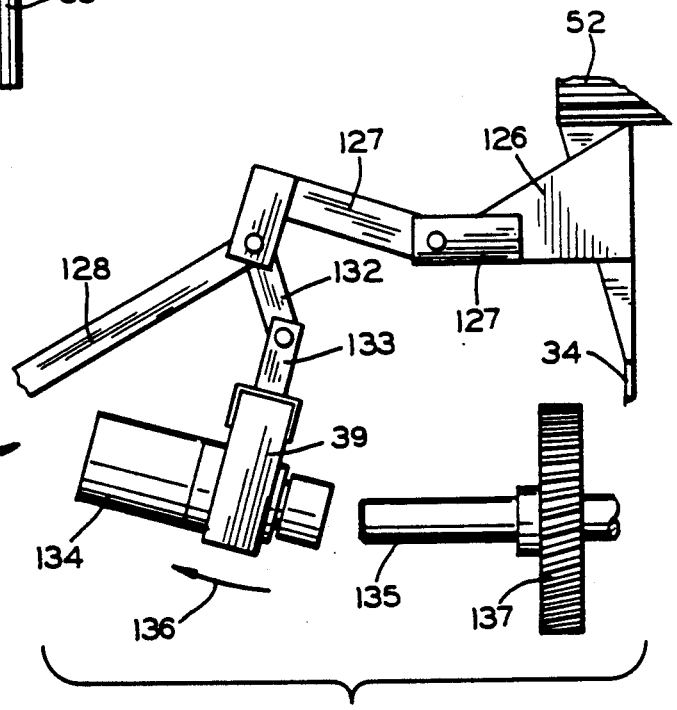
FIG. 6 is a view similar to FIG. 5 with the support frame and the printing cylinder drive shown in a detached position.

FIGS. 5 through 7 illustrate a support frame for the Printing cylinder drive, the computer 111 and the camera monitor 124. A portion of each of the support posts 34 extends rearwardly and attaches to a front edge of the third support 52. A support bracket 126 is attached to and extends outwardly from a generally vertically extending outer wall of the support post 34 adjacent the printing cylinder drive motor 38 and the gear box 39. A lower end of a generally vertically extending post 127 is attached to the support bracket 126. The lower end of the post 127 is pivotally attached to the support bracket 126 and extends outwardly and upwardly. One end of a generally horizontally extending arm 128 is pivotally attached to an upper end of the post 127. A computer and camera monitor housing 129 is pivotally attached to an opposite end of the arm 128. As shown in FIG. 5, the housing 129 supports a monitor 130 for the computer 111, the camera monitor 124, the computer 111 and a keyboard 131 for the computer 111. The pivotal connections between the support bracket 126 and the post 127, between the post 127 and the arm 128, and between the arm 128 and the housing 129 permit the housing 130 to be pivoted toward the rear of the apparatus 21 when the printing cylinder 35 is being changed or during any other manual operation.

A relatively short arm 132 is pivotally connected between a lower end of the post 127 and a mounting bracket 133. The anti-backlash gearbox 39 is attached to the mounting bracket 133 and mounted on the gearbox 39 is an actuator 134. The actuator 134 operates a coupling for connecting and disconnecting an output of the gearbox 39 to a drive shaft 135. When the actuator 134 uncouples the gearbox 39 from the drive shaft 135, the drive motor 38, the gearbox 39 and the actuator 134 can be pivoted away from the drive shaft 135 in the direction of an arrow 136 shown in FIG. 6. The uncoupling of the gearbox 39 permits the changing of a gear 137 mounted on the drive shaft 135 or the removal of the printing cylinder 35 from the apparatus 21.

Figure 8:
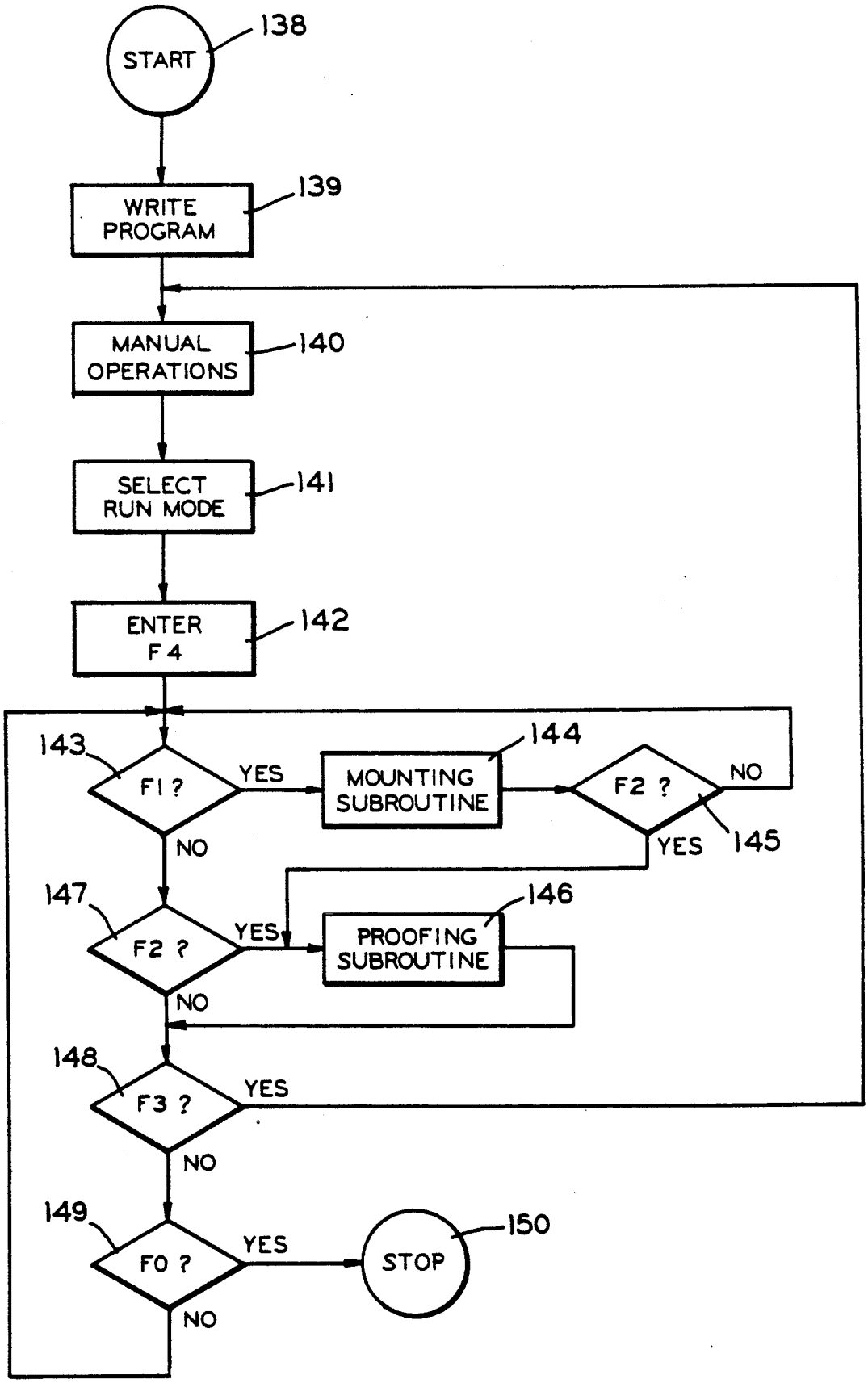
FIG. 8 is a flow diagram of the operation of the mounting and proofing apparatus according to the present invention.

The operation of the mounting and proofing apparatus 21 will now be described in connection with a flow diagram shown in FIG. 8. The operation begins at a circle START 138. The operator executes an instruction set WRITE PROGRAM 139 wherein various variables are designed in a job file as follows:

Write Program:

1. Name the job (Leader).
2. Describe the job (2ACR-1ARD 4 color+varnish).
3. Select the cylinder (number of teeth).
4. Length of cylinder.
5. Plate Width, Plate Depth, Ref 1x, Ref 1y, Ref 2x, Ref 2y, Cyl x, Cyl y.

Definitions:

A. Plate Width (side to side) as operator stands on machine platform.
B. Plate Depth (in and out) as operator stands on machine platform.
C. Ref 1x=First register point location on "X" axis.
D. Ref 1y=First register point location on "Y" axis.
E. Ref 2x=Second register point location on "X" axis.
F. Ref 2y=Second register point location on "Y" axis
G. Cyl x=Plate center point left or right off center point of cylinder.
H. Cyl y=Plate center point around cylinder off center point of cylinder.
I. Plate thickness.
J. Backing thickness.

Next the operator enters an instruction set MANUAL OPERATIONS 140 wherein the following steps are performed:

Machine Operation:

1. Turn on power (pull switch). Push start switch.
2. Allow computer to boot-up.
3. Type in "Operator".
4. Follow screen instructions
5. Select operation mode.
6. Manually
   a) Locate table right of center.
   b) Locate camera left-front.
   c) Locate table to back.
   d) Unclamp.
7. Put substrate on proofing cylinder—securely.
8. Place printing cylinder into lower bearing housing holders.
9. Move gear on shaft so the gear rub plate can be installed. Install the gear rub plate.
10. Push the gear against the rub plate.
11. Install the cylinder squeeze collar against the gear and tighten (2) squeeze screws. Tighten (4) set screws uniformly so the cylinder cannot be moved. Loosen (4) set screws 1/16 of turn uniformly.
12. Install gripping collar securely.
13. Swing controls and printing cylinder drive to front, place control in mount position (left of platform rail collar).
14. Slide gripping collet on cylinder shaft.
15. Clean cylinder surface.
16. Apply adhesive.
17. Remove paper.
18. Check for air bubbles, gaps and/or overlays. Make the necessary adjustments. Check that the camera is in left-front and table is to the right of the center line
19. Quit from manual mode. The operator executes an instruction set SELECT RUN MODE 141 wherein the following steps are performed:
20. Select run mode. Type job selection name (Leader). Type security code.
21. Select the plates to be mounted. The operator then executes an instruction set ENTER F4 142 wherein the following steps are performed:
22. Hit the F4 key to home the unit.
    a) The machine checks to see if the cylinder is correct, sends the camera home, table-up home, table side to side home, then camera over rotating plate center point.
    b) Raises proofing cylinder to proximity hole position.
    c) Homes proofing cylinder and printing cylinder.
    d) Unclamps collet, meshes gears, clamps collet (times printing cylinder and proofing cylinder together). proofing cylinder lowers to proximity hole position.

The operator now has the option to mount a plate, proof a plate already mounted, enter the manual mode or quit the job. The computer program enters a decision point 143 wherein a check is made to see if the F1 key has been pressed. If the F1 key has been pressed, the program exits at "YES" and enters an instruction set MOUNTING SUBROUTINE 144. The computer then performs the following instructions: To mount, hit F1 Move table down.

Move table ahead.
Hit F1 to continue.
Hit F1 for auto seek (camera locates approximate register point position).
Place plates on table (approximately 1 ½° right of square and 2" off front).
Place register point hold down bar behind points.
Hit F1; vacuum comes on.
Hit F1; camera goes to approximate location of first point.
Place camera over first register point.
Hit Esc.; camera automatically goes for second point.
Place the camera over the second point.
Hit Esc. and any key or Esc. twice.
Any key will move the camera over second point after rotation.
Any key again; camera goes to first register point.
Hit Esc.; camera goes to home.
Hit Esc.; printing cylinder rotates to mount position.
Hit Esc.; table moves left to right to mount position.
Hit F1 plus any key.
Hit F1; pressure roll lowers pressing printing plate to adhesive.
Hit F1; printing cylinder rotates to mount plate. *Remove hold down bar before it gets to pressure roll.*
Hit any key twice. This raises the pressure roll.
Continue until all selected plates are mounted After the mounting subroutine is complete, the computer checks at a decision point 145 for the actuation of the F2 key. If the F2 key has not been pressed, the program branches from the decision point 145 at "NO" back to the decision point 143. If the F2 key has been pressed indicating that proofing is desired, the program branches from the decision point 145 at "YES" to an instruction set PROOFING SUBROUTINE 146. The instruction set 146 is also entered if the F1 key has not been actuated at the decision point 143. The program branches from the decision point 143 at "NO" and enters a decision point 147 which checks for the actuation of the F2 key. If the F2 key has been actuated, the program branches at "YES" to the instruction set 146 The instruction set 146 executes the following instructions:

Hit F2 when complete to proof.
Ink cylinder (goes in proofing direction only).
Hit Esc. when complete. (Proofer and cylinder will home for correct tooth mesh.)
Hit F1 to continue.
Proofer rises.
Hit F1 to proof. (If more pressure is required, F9 then read screen for side needing more.)
Use ink key to clean off plates, if desired.
Hit Esc. or reset (if wanting to re-proof).

When the proofing subroutine 146 is complete, the program enters a decision point 148 to check for actuation of the F3 key. If the F2 key has not been actuated at the decision point 147, the program will branch at "NO" to the decision point 148. If the F3 key has been actuated, the program will branch from the decision point 148 at "YES" and return to the instruction set 140 for manual operation of the apparatus 21. If the F3 key has not been actuated, the program will branch from the decision point 148 at "NO" to a decision point 149. If the F0 key has been actuated, the program will branch from the decision point 149 at "YES" and enter a circle STOP 150. The computer program is now complete and the following manual operations are performed:

Back to main menu.
Select unclamp.
Select quit.
Hit enter.
Type "Operator".
Lower printing cylinder to home.
Remove printing cylinder. Remove squeeze clamp, spacers, and top bearing caps.

If the F0 key has not been actuated, the program will branch from the decision point 149 at "NO" and return to the decision point 143.

Each of the motors shown in FIG. 4, with the exception of the lift motor 97 is connected to a separate feedback position generator for indicating to the computer 111 the position of the associated portion of the apparatus 21 being moved by the motor. For example, a position feedback generator 151 is connected between the drive motor 38 and the motor driver 112. The feedback position generator 151 senses the rotational position of the output shaft of the drive motor 38 and generates a feedback signal representing that position to the motor driver 112. The motor driver 112 generates the feedback signal to the computer 111 such that the computer 111 is constantly updated as to the rotational position of the printing cylinder 35. A similar feedback generator is connected between each of the motors 45. 49, 61, 63, 67, 70, 86 and 93 and their associated motor drivers. Thus, the computer 111 receives feedback signals indicating the rotational position of the proofing cylinder 41, the position of the support table 53 along each of the "X", "Y". and "Z" axes, the rotational position of the turntable 68 and the position of the camera 90 along the "X" and "Y" axes.

Also shown in FIG. 4 are homing switches 152*a*, 152*b* and 152*c*. The homing switch 152*a* is positioned adjacent the printing cylinder 35 and is connected to generate a signal to the computer 111 indicating a predetermined rotational orientation of the printing cylinder. This signal can be utilized rotate the cylinder to a "home" position and to check the feedback signal from the position feedback generator 151. The homing switch 152*b* is positioned adjacent the proofing cylinder 41 and performs a function similar to the switch 152*a*. The homing switch 152*c* is positioned adjacent the shaft (not shown) coupling the output of the gear box 69 with the turntable 68 for performing a function similar to the switch 152*a*.

Also shown in FIG. 4 are a pair of end of travel switches 153*a* and 153*b*. The switches 153*a* and 153*b* are located at opposite ends of the path of travel of the pressure roll 99. If the pressure roll 99 is driven to the end of its path of travel and engages one of the switches 153*a* and 153*b*, a signal is generated to the computer 111 to indicate that the lift motor 97 is to be turned off in order to protect the pressure roll drive apparatus from damage. Although not shown, similar pairs of switches can be utilized with each of the motors for the support table 53 and each of the motors for the camera 90.

Referring to FIGS. 2 and 4, the vacuum pump 122 is connected through vacuum solenoids 123 to a plurality of grooves 154*a* through 154*d* formed in an upper surface of the turntable 68. The grooves 154*a* through 154*d* represent a plurality of different size printing plates. When a printing plate is placed on the upper surface of the turntable 68, the vacuum solenoids 123 are actuated. The computer 111 has stored the information as to the size of the printing plate as entered by the operator and actuates the solenoids 123 associated with the ones of the grooves 154a through 154d which are covered by the printing plate. Thus, the vacuum pump 122 and the ones of the vacuum solenoids 123 that are actuated apply a vacuum to the covered ones of the grooves 154a through 154d thereby firmly holding the printing plate on the upper surface of the turntable 68.

During proofing, rotating the inked printing plate on the printing cylinder against the proofing cylinder, the gear 137 shown in FIG. 3 meshes with a gear 155 attached to the proofing cylinder axle 42 to rotate the proofing cylinder 41 and print on a substrate. Although the motor 38 could drive both cylinders, the computer 111 can also control the motor 49 to drive the proofing cylinder in synchronism.

Figure 9:
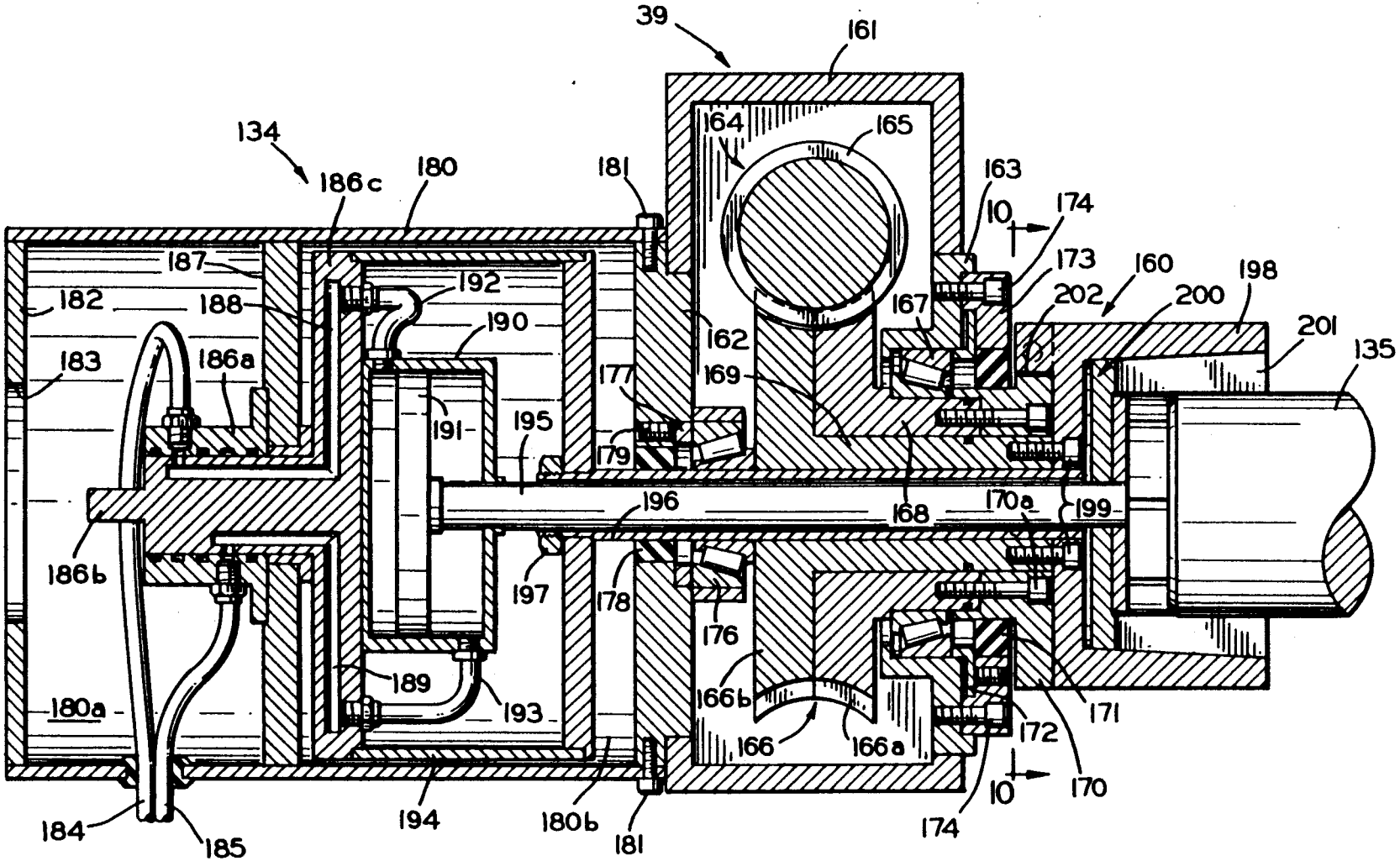
FIG. 9 is an enlarged cross-sectional view of the actuator, the gear box and the drive shaft coupling shown in FIG. 3.

FIG. 9 is a cross-sectional view of the drive shaft coupling actuator 134 and the anti-backlash gearbox 39 shown in FIG. 3. The actuator 134 is attached to one side of the gearbox 39. A coupling 160, which is controlled by the actuator 134, is mounted on an opposite side of the gearbox 39 adjacent the drive shaft 135. The gearbox 39 includes an outer housing 161 having an actuator mounting plate 162 retained in an aperture formed in a wall of the housing facing the actuator 134. A second mounting plate 163 is retained in an aperture formed in a wall of the housing 161 facing the coupling 160.

Positioned inside the housing 161, between the two mounting plates 162 and 163, is a worm gear drive 164. The worm gear drive includes a screw or worm 165 which is coupled to an output shaft of the printing cylinder drive motor 38. The drive motor 38 rotates the worm gear 165 which drives a split gear 166. The split gear 166 is divided into two portions in a plane which includes a diameter of the worm 165. The mounting plate 163 has an aperture formed therein for retaining an outer race of a roller bearing 167. The split gear 166 has an extension or hub which extends to the right in FIG. 9 along the longitudinal axis of the drive shaft 135 and through the bearing 167. A right hand portion 166a of the split gear 166 forms an outer surface 168 of the hub on which an inner race of the roller bearing 67 is mounted. Thus, the split gear 166 is rotatably mounted by the plate 163.

A left hand portion 166b of the split gear 166 has a hub 169 which extends along the longitudinal axis of the drive shaft 135 through a central aperture formed in the hub 168. The hub 169 extends beyond an outer end of the hub 168 and through a central aperture formed in a collar 170. The collar 170 is attached to the end of the hub 168 by a plurality of suitable threaded fasteners 170a extending through apertures formed in the hub and engaging threaded apertures formed in the end of the hub 168. Positioned between the collar 170 and the bearing 167 is an annular seal 171 and an adjustment ring 172. The seal 171 extends around a reduced diameter inner portion of the collar 170 and seals against an edge of an aperture formed in a cover plate 173. The cover plate 173 is attached to the outer surface of the second mounting plate 163 by a plurality of suitable threaded fasteners 174 which extend through apertures formed in the cover plate and engage threaded apertures formed in the second mounting plate.

An adjusting screw 175 is retained in a threaded aperture formed in the cover plate 173 and an inner end of the adjusting screw abuts the adjustment ring 172. The adjusting screw 175 can be utilized to move the adjustment ring 172 toward the split gear 166 and into contact with the outer race of the roller bearing 167. The adjusting screw 175 can be further rotated to force the roller bearing 167 against the right hand portion 166a of the split gear 166 to center the split gear 166 with respect to the worm gear 165. Similarly, an outer race of a roller bearing 176 is mounted on the inside of the first mounting plate 162. An inner race of the roller bearing 176 abuts the left hand portion 166b of the split gear 166. Mounted in a central aperture formed in the mounting plate 162 is an adjustment ring 177 and an annular seal 178. An adjusting screw 179 is retained in a threaded aperture formed in the mounting plate 162 and an inner end of the screw 179 abuts the adjustment ring 177. Thus, the screw 179 can be utilized to move the adjustment ring 177 into engagement with the outer race of the roller bearing 176 and further center the left hand portion 166b of the split gear 166 with respect to the worm gear 165.

The actuator 134 includes a generally cylindrical housing 180 attached at one end by a plurality of threaded fasteners 181 to the mounting plate 162. The opposite end of the housing 180 is closed by an end plate 182 having a central aperture 183 formed therein. An encoder (not shown) can be mounted in the aperture or the aperture can be closed by any suitable cover (not shown).

A pair of hydraulic lines 184 and 185 extend through an aperture formed in wall of the housing 180 and are connected to an outer housing 186a of a generally cylindrical manifold. The outer housing 186a is attached an interior wall 187 which divides the housing 180 into a left chamber 180a and a right chamber 180b. The lines 184 and 185 and the outer housing 186a are positioned in the left chamber 180a. Rotatably supported inside the outer housing 186a is a generally cylindrical inner body 186b. Formed in the manifold body 186b are a pair of axially extending passages 188 and 189 in fluid communication with the lines 184 and 185 respectively through the outer housing 186a. The body 186b extends through the wall 187 into the right chamber 180b and expands into an increased diameter portion 186c. The passages 188 and 189 turn radially outwardly and terminate adjacent the outer periphery of the increased diameter portion 186c.

Attached to the manifold portion 186c in the right chamber 180b is an hydraulic cylinder 190. Positioned in the hydraulic cylinder 190 is a piston 191. The interior portion of the hydraulic cylinder to the left of the piston 191 is connected by a hose 192 with the end of the passage 188 in the body portion 186c. Similarly, the portion of the hydraulic cylinder 190 to the right of the piston 191 is connected by a hose 193 with the end of the passage 189 in the body portion 186c. The manifold body portions 186b and 186c, together with the hydraulic cylinder 190, the piston 191, and the lines 192 and 193, are free to rotate about an axis which is co-extensive with the axis of rotation of the split gear 166.

The cylinder 190 is enclosed by a cup-shaped housing 194 attached to the manifold body portion 186c. An actuator shaft 195 is attached at one end to the piston 191 and extends through an end wall of the hydraulic cylinder 190 and an end wall of the housing 194. The actuator shaft 195 continues through the interior of a hollow tube 196. One end of the tube 196 is of reduced diameter and extends into the interior of the housing 194 through its end wall. This end of the tube 196 is threaded and is retained in the end wall by a threaded ring 197. The shaft 195 and the tube 196 extend through the seal 178, the roller bearing 176, and the gear portions 166*b* and 166*a*. The opposite end of the tube 196 extends into an aperture formed in an end wall of a generally cylindrical housing 198 of the coupling 160. The end wall of the housing 198 is attached to the hub 169 by a plurality of threaded fasteners 199 which extend through apertures formed in the end wall and engage threaded apertures formed in an end surface of the hub 169.

The opposite end of the actuator shaft 195 terminates inside the housing 198 and is attached to an end wall of a cup-shaped shaft retainer 200. The interior of the housing 198 tapers inwardly from right to left in FIG. 9. The cup-shaped shaft retainer 200 has a side wall with an outer circumferential surface which is tapered to match the taper in the interior of the housing 198. The side wall of the retainer 200 is slotted to form a plurality of axially extending finger segments 201. As shown in FIG. 9, assume that hydraulic fluid has been supplied through the hydraulic line 185, the passageway 189, and the hose 193 to the right hand portion of the interior of the hydraulic cylinder 190 thereby moving the piston 191 to its rearward position. Excess fluid in the left hand portion of the hydraulic cylinder 190 has been forced out through the hose 192, the passageway 188 and the hydraulic line 184. The movement of the piston 191 to the position shown in FIG. 9 draws the exterior surface of the retainer 200 into engagement with the interior surface of the housing 198 forcing the segments 201 inwardly into tightly gripping engagement with the exterior surface of the drive shaft 135. Thus, the drive shaft 135 is tightly gripped for rotation by the worm gear drive 164 which is attached to the housing 198.

Figure 10:
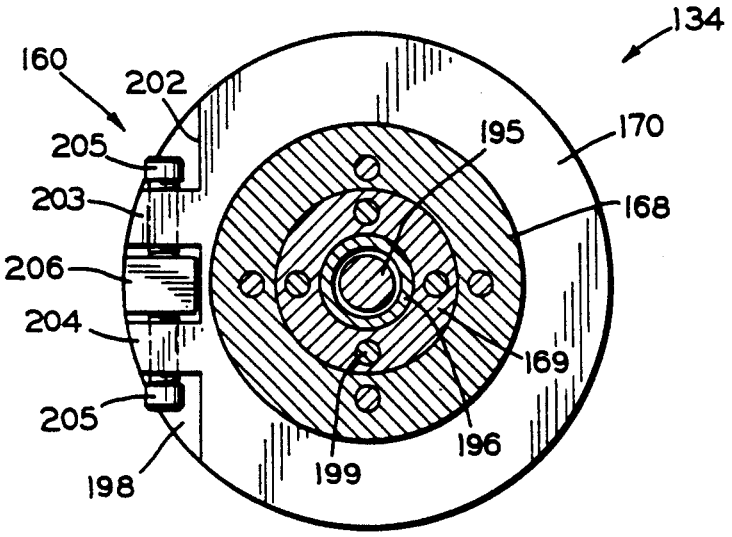
FIG. 10 is a cross-sectional view of the drive shaft coupling as if taken along the line 10—10 in FIG. 9.

Referring now to FIGS. 9 and 10, there is shown a third adjustment for the worm gear drive. The larger diameter outer end of the collar 170 has a flat 202 formed on an outer surface thereof. Extending upwardly from the surface of the flat 202 is a pair of spaced apart ribs 203 and 204 which extend generally parallel to the longitudinal axis of the drive shaft 135. A pair of threaded fasteners 205 are threadably engaged in apertures formed in associated ones of the ribs 203 and 204. Positioned between the ribs 203 and 204 is a longitudinally extending tab 206 formed on an end surface of the housing 198. The width of the tab 206 is less than the distance between the interior facing surfaces of the ribs 203 and 204. Thus, the threaded fasteners 205 can be threaded into engagement with opposite sides of the tab 206 thereby permitting positioning of the tab at any selected point between the interior surfaces of the ribs 203 and 204. Since the collar 170 is attached to the right hand portion 166*a* of the split gear 166 and the housing 198 is attached to the hub 169 of the left hand portion 166*b*, the threaded fasteners 205 and the tab 206 provide a means for rotatably adjusting the split gear portions 166*a* and 166*b* relative to one another to take up any backlash in the worm gear drive 164.

Figure 11:
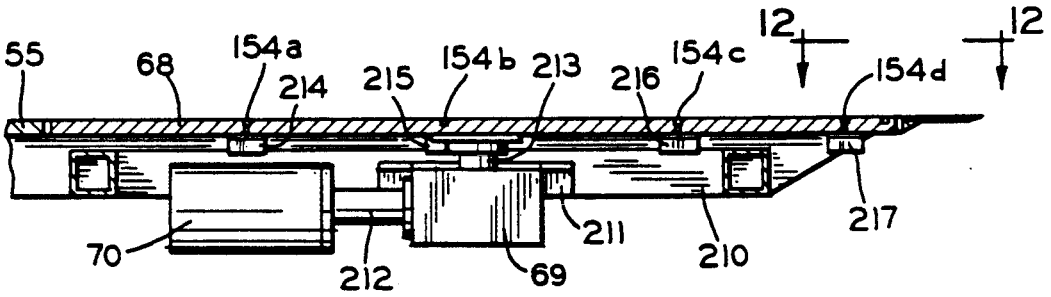
FIG. 11 is an enlarged cross-sectional view of the turntable shown in FIG. 2.

Referring to FIG. 11, there is shown a cross sectional view taken through the turntable 68 which is located in an aperture formed in the upper plate 55. The upper surface of the upper plate can be supported by a frame 210. The gear box 69 is mounted under the turntable 68 and is attached to the frame 210 by a bracket 211. The turntable drive motor 70 is coupled to an input shaft 212 of the gear box 69. An output shaft 213 of the gear box 69 is coupled to the lower surface of the turntable 68 at its center of rotation. Thus, the turntable 68 is rotatably supported by the gearbox 69. Attached to the frame 210 are a plurality of manifold blocks for supplying vacuum to the turntable grooves 154*a* through 154*d*. For example, a manifold block 214 supplies vacuum to the groove 154*a* and manifold blocks 215, 216 and 217 supply vacuum to the turntable grooves 154*b*, 154*c* and 154*d* respectively.

Figure 12:
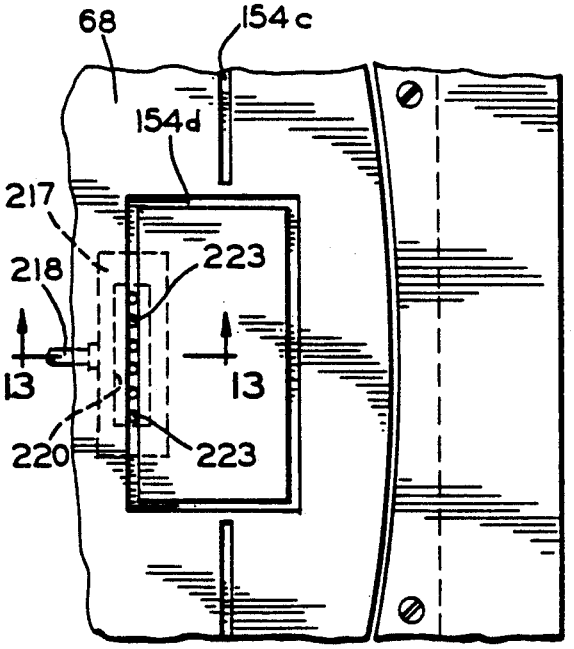
FIG. 12 is an enlarged fragmentary top plan view of the turntable as if taken along the line 12—12 in FIG. 11.
Figure 13:
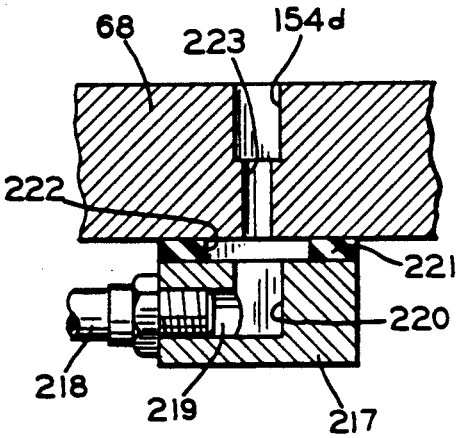
FIG. 13 is an enlarged cross-sectional view of the turntable showing a groove and a manifold block as if taken along the line 13—13 in FIG. 12.

Referring to FIGS. 12 and 13, there is shown in more detail the groove 154*d* and the manifold block 217. Connected to the manifold block 217 is a vacuum supply line 218 which is connected through the vacuum solenoids 123 to the vacuum pump 122 which are shown in FIG. 1 and FIG. 4. An end of the line 218 is attached at an inlet 219 is in fluid communication with an elongated outlet passage 220 formed in an upper surface of the manifold block 217. A suitable gasket 221 is positioned between the upper face of the manifold block 217 and a lower face of the turntable 68. The gasket 221 enables relative movement between the turntable 68 and the manifold block 217 when the turntable 68 is rotated while still providing a vacuum seal. The gasket 221 has a central aperture 222 formed therein such that the gasket 221 completely surrounds the outlet 220. A plurality of apertures 223 are formed between the bottom wall of the turntable groove 154*d* and the bottom surface of the turntable 68. Thus, when the associated solenoid valve is actuated, the vacuum pump 122 will supply vacuum through the line 218. the passage 219, the outlet 220, the aperture 222 in the gasket 221, the apertures 223 to the groove 154*d*.

The apparatus for mounting flexible printing plates on a printing cylinder, as described above, includes means for rotatably supporting a printing cylinder in a predetermined position, a support table adjacent the means for rotatably supporting and having a surface for supporting a flexible printing plate having a reference point thereon and means for moving coupled to at least one of the support table and the means for rotatably supporting for moving that one along at least two of three orthogonal axes for positioning the printing plate at a desired position along the axes relative to the printing cylinder. The support table has a turntable formed therein for supporting a printing plate and an actuator coupled to the turntable for rotating the turntable about a central axis. The turntable has a plurality of grooves formed in an upper surface thereof and a vacuum pump is connected to the grooves through a plurality of associated valves and manifold blocks for selectively controlling the application of a vacuum to each of the grooves to retain a printing plate on the turntable.

Means for rotating a printing cylinder are supported by the means for rotatably supporting and include a gearbox having a drive motor coupled to an input and printing cylinder drive shaft coupling coupled to an output. The gearbox has a worm gear drive connected between the input and the output and means for adjusting backlash in the worm gear drive.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for mounting flexible printing plates on a printing cylinder comprising:

means for rotatably supporting a printing cylinder in a predetermined position;

a support table adjacent said means for rotatably supporting and having a turntable formed therein for supporting a flexible printing plate having a reference point thereon; and means for moving coupled to at least one of said support table and said means for rotatably supporting for moving said one along at least two of three orthogonal axes for positioning said turntable at a desired position along said axes relative to said means for rotatably supporting whereby a printing plate on said turntable has a reference point at said desired position relative to a printing cylinder on said means for rotatably supporting.

2. The apparatus according to claim 1 wherein said means for rotatably supporting supports a printing cylinder with a longitudinal axis of the printing cylinder parallel to one of said three axes.

3. The apparatus according to claim 1 wherein said turntable is rotatably mounted on said support table.

4. The apparatus according to claim 3 including an actuator coupled to said turntable for rotating said turntable about a central axis.

5. The apparatus according to claim 1 wherein said turntable has a plurality of grooves formed in an upper surface thereof, and including a vacuum pump and a plurality of associated valves, said vacuum pump being connected to said grooves through said valves for selectively controlling the application of a vacuum to each of said grooves.

6. The apparatus according to claim 5 wherein said turntable is planar and including a manifold block attached to said support table and connected to said vacuum pump for supplying a vacuum to an associated one of said grooves.

7. The apparatus according to claim 6 including a vacuum supply line and wherein said manifold block has an inlet and an elongated passage formed therein, said inlet being connected to one end of said vacuum supply line having an opposite end connected to said vacuum pump, and said inlet being in fluid communication with said elongated outlet passage formed in said block and positioned below said associated groove.

8. The apparatus according to claim 7 wherein said turntable has a plurality of apertures formed between a bottom wall of said associated groove and a lower surface of said turntable for fluid communication between said outlet passage and said associated groove.

9. The apparatus according to claim 5 wherein said turntable is planar and including a plurality of manifold blocks attached to said support table, each of said manifold blocks being connected to said vacuum pump for supplying a vacuum to an associated one of said grooves.

10. The apparatus according to claim 1 including means for rotating a printing cylinder supported by said means for rotatably supporting, said means for rotating including a gearbox having an input and an output, a drive motor coupled to said input and a drive shaft coupling coupled to said output.

11. The apparatus according to claim 10 wherein said gearbox has a worm gear drive connected between said input and said output and means for adjusting backlash in said worm gear drive.

12. The apparatus according to claim 11 wherein said worm gear drive includes a worm connected to said input and a split gear connected to said output, said split gear having a right hand portion and a left hand portion and said means for adjusting backlash rotates said split gear portions relative to one another.

13. The apparatus according to claim 10 wherein said gearbox has a worm gear drive connected between said input and said output and means for adjusting backlash in said worm gear drive, said worm gear drive including a worm connected to said input and a split gear connected to said output, said split gear having a right hand portion and a left hand portion, and said means for adjusting backlash is connected to said split gear portions for rotating said split gear portions relative to one another.

14. The apparatus according to claim 13 wherein said means for adjusting backlash includes a collar having a pair of spaced apart ribs formed thereon and being attached to said right hand portion of said split gear, a tab formed on said drive shaft coupling, said drive shaft coupling being attached to said left hand portion of said split gear and said tab being positioned between said ribs, and means for selectively positioning said tab between said ribs to rotate said split gear portions relative to one another.

15. An apparatus for mounting flexible printing plates on a printing cylinder comprising:

a ground engaging base;

a support table mounted on said base;

means attached to said support table for moving said support table along three orthogonal axes;

means for rotatably supporting a printing cylinder on said base;

a gearbox mounted on said means for rotatably supporting and having an input and an output;

a drive motor connected to said gearbox input; and a drive shaft coupling connected to said gearbox output for selectively engaging a drive shaft of a printing cylinder.

16. The apparatus according to claim 15 wherein said means for moving includes three actuators, each actuator having a drive motor coupled to said support table and a motor driver connected to said drive motor for moving said support table along an associated one of said three axes.

17. The apparatus according to claim 15 wherein said gearbox has a worm gear drive connected between said input and said output and means for adjusting backlash in said worm gear drive.

18. The apparatus according to claim 17 wherein said worm gear drive includes a worm connected to said input and a split gear connected to said output, said split gear having a right hand portion and a left hand portion and said means for adjusting backlash rotates said split gear portions relative to one another.

19. The apparatus according to claim 15 wherein said gearbox has a worm gear drive connected between said input and said output and means for adjusting backlash in said worm gear drive, said worm gear drive including a worm connected to said input and a split gear connected to said output, said split gear having a right hand portion and a left hand portion, and said means for adjusting backlash is connected to said split gear portions for rotating said split gear portions relative to one another.

20. The apparatus according to claim 19 wherein said means for adjusting backlash includes a collar having a pair of spaced apart ribs formed thereon and being attached to said right hand portion of said split gear, a tab formed on said drive shaft coupling, said drive shaft coupling being attached to said left hand portion of said split gear and said tab being positioned between said ribs, and means for selectively positioning said tab between said ribs to rotate said split gear portions relative to one another.

21. The apparatus according to claim 15 including a proofing cylinder rotatably supported on said base and an actuator coupled to said proofing cylinder for rotating said proofing cylinder.

22. The apparatus according to claim 21 including a pair of lift actuators attached at opposite ends of said proofing cylinder for raising said proofing cylinder toward a printing cylinder mounted on said means for rotatably supporting.

23. The apparatus according to claim 15 including a pressure roll supported above said means for rotatably supporting and a lift motor coupled to said pressure roll for lowering said pressure roll toward said means for rotatably supporting and lifting said pressure roll.

24. In an apparatus for mounting flexible printing plates on a printing cylinder including a support table having a turntable formed therein for supporting a printing plate, the turntable comprising:

a generally circular plate having a plurality of grooves formed in an upper surface thereof; and means for selectively applying a vacuum to each of said grooves.

25. The apparatus according to claim 24 including an actuator connected to said plate for rotating said plate about a central axis, said actuator being mounted on a support table having the turntable formed therein.

26. The apparatus according to claim 24 wherein said plate has a plurality of grooves formed in an upper surface thereof and including a vacuum pump and a plurality of associated valves, said vacuum pump being connected to said grooves through said valves for selectively controlling the application of a vacuum to each of said grooves.

27. The apparatus according to claim 26 including a manifold block attached to a support table and connected to said vacuum pump for supplying a vacuum to an associated one of said grooves.

28. The apparatus according to claim 27 including a vacuum supply line and wherein said manifold block has an inlet and an elongated passage formed therein, said inlet being connected to end of said vacuum supply line having an opposite end connected to said vacuum pump, and said inlet being in fluid communication with said elongated outlet passage formed in said block and positioned below said associated groove.

29. The apparatus according to claim 28 wherein said associated groove has a bottom wall and said plate has a lower surface and a plurality of apertures formed between said bottom wall of said associated groove and said lower surface of said plate for fluid communication between said outlet passage and said associated groove.

30. The apparatus according to claim 29 including a gasket positioned between said manifold block and said lower surface of said plate, said gasket having an opening formed therein connecting said outlet passage with said plurality of apertures.

31. The apparatus according to claim 26 including a plurality of manifold blocks attached to a support table, each of said manifold blocks being connected to said vacuum pump for supplying a vacuum to an associated one of said grooves.

* * * * *